United States Patent [19]

Griffin

[11] Patent Number: 4,949,598

[45] Date of Patent: Aug. 21, 1990

[54] MANUFACTURE OF ROTARY DRILL BITS

[75] Inventor: Nigel D. Griffin, Whitminster, England

[73] Assignee: Reed Tool Company Limited, Gloucestershire, England

[21] Appl. No.: 265,238

[22] Filed: Oct. 31, 1988

[30] Foreign Application Priority Data

Nov. 3, 1987 [GB] United Kingdom ..... 8725671

[51] Int. Cl.[5] ..... B22F 7/08

[52] U.S. Cl. ..... 76/108.2; 419/9; 419/36

[58] Field of Search ..... 76/108 A, 108 R, 101 R, 76/101 E, DIG. 11, DIG. 12; 419/5, 8, 9, 36, 56, 58, 59

[56] References Cited

U.S. PATENT DOCUMENTS

| | | | |
|---|---|---|---|
| 4,396,077 | 8/1983 | Radtke | 76/108 A |
| 4,499,795 | 2/1985 | Radtke . | |
| 4,505,342 | 3/1985 | Barr et al. . | |
| 4,608,225 | 8/1986 | Sakuramoto et al. | 419/5 |
| 4,630,692 | 12/1986 | Ecer | 76/108 A |
| 4,676,324 | 6/1987 | Barr et al. . | |
| 4,762,028 | 8/1988 | Regan | 76/108 A |

FOREIGN PATENT DOCUMENTS

| | | |
|---|---|---|
| 0145421 | 6/1985 | European Pat. Off. . |
| 0198627 | 10/1986 | European Pat. Off. . |
| 0219959 | 4/1987 | European Pat. Off. . |
| 2812590 | 9/1978 | Fed. Rep. of Germany . |

*Primary Examiner*—Roscoe V. Parker

*Attorney, Agent, or Firm*—Browning, Bushman, Anderson & Brookhart

[57] ABSTRACT

A rotary drill bit is manufactured by forming a main bit body part from a machinable metal, such as steel, machining sockets in the outer surface of the main bit, inserting in each socket a thermally stable cutting structure or former which substantially fills at least the mouth of the socket and projects beyond the outer surface of the main bit body part, applying to the surface of the main bit body part, at least in an area surrounding each socket, a compound comprising powdered matrix-forming material, such as powdered tungsten carbide, mixed with a binder to form a paste, and infiltrating the matrix-forming compound with a metal alloy in a furnace to form a hard matrix. The size, location and orientation of the sockets may thus be accurately determined using conventional machining techniques, as in the case of an ordinary steel-bodied bit, but the external parts of the bit body are formed of hard solid matrix material and are thus highly resistant to erosion.

23 Claims, 1 Drawing Sheet

MANUFACTURE OF ROTARY DRILL BITS

BACKGROUND OF THE INVENTION

The invention relates to the manufacture of rotary drill bits for use in drilling or coring deep holes in subsurface formations.

The invention is applicable to rotary drill bits of the kind comprising a bit body having a shank for connection to a drill string, a bit face on the bit body, a plurality of cutting structures mounted in sockets in the bit body and projecting from the face of the bit, and a number of nozzles also mounted in sockets in the bit body and communicating with a passage for supplying drilling fluid to the face of the bit.

Each cutting structure may comprise a cutting element mounted on a carrier, such as a stud or post, which is received in a socket in the bit body. One common form of cutting element comprises a circular tablet having a hard facing layer of polycrystalline diamond or other superhard material and a backing layer of less hard material such as cemented tungsten carbide.

Rotary drill bits of this kind are commonly formed by one of two basic methods. In one method, the bit body is formed by a powder metallurgy process. In this process a hollow mould is first formed, for example from graphite, in the configuration of the bit body or a part thereof. The mould is packed with a powdered matrix-forming material, such as tungsten carbide, which is then infiltrated with a metal alloy, such as a copper alloy, in a furnace so as to form a hard matrix. In order to form the sockets to receive the cutting structures, it is usual for formers, also for example of graphite, to be mounted on the interior surface of the mould before it is packed with tungsten carbide. After the bit body has been formed the formers are removed and the carriers of the cutting structures are located and secured within the resulting sockets. Bit bodies formed by this process have the advantage of being highly resistant to erosion during use, due to the hardness and wear resistance of the matrix material. One problem with such method however, is that it is extremely difficult to control to a great degree of accuracy the size, location and orientation of the sockets in the bit body and this may lead to difficulties in fitting the cutting structures within the sockets. Resulting inaccuracies in the orientation of the cutting structures may also have a deleterious effect on the performance of the bit.

In an alternative method of construction, the bit body is machined from a solid blank of machinable metal, usually steel. Since the sockets are then formed in the bit body by machining it is possible to determine their size, location and orientation with great accuracy, for example by using computer controlled machining tools. However, the bit face of a steel-bodied bit is susceptible to wear and erosion during use, particularly in the vicinity of the cutting structures and of the nozzles from which drilling fluid emerges at high velocity and with substantial turbulence. Accordingly, attempts have been made to increase the wear-resistance of steel-bodied bits by applying a hard facing to the bit face, around the cutting structures. Various hard facing materials and methods have been employed but all suffer from certain disadvantages.

It would therefore be desirable to combine the accuracy of manufacture of steel bodied bits with the erosion resistance of matrix bits, and the present invention sets out to achieve this.

SUMMARY OF THE INVENTION

According to the invention there is provided a method of manufacturing a rotary drill bit which includes the steps of forming a main bit body part from a machinable metal, such as steel, machining in the outer surface of the main bit body part a plurality of sockets, inserting in each of said sockets an element which substantially fills a least the mouth of the socket and projects beyond the outer surface of the main bit body part, applying to the surface of the main bit body part, at least in an area surrounding each said socket, a compound comprising powdered matrix-forming material mixed with a binder to form a paste, and infiltrating said matrix-forming compound with a metal alloy in a furnace to form a hard matrix.

Using the method according to the invention, the size, location and orientation of the sockets may be accurately determined using conventional machining techniques, as in the case of an ordinary steel-bodied bit, but the external parts of the bit body are formed of hard solid matrix material and are thus highly resistant to erosion.

In order to infiltrate the matrix-forming compound, it may be enclosed, before infiltration, by packing particulate mould-forming material around the main bit body part, or at least the areas thereof to which said compound is applied. Alternatively, the main bit body part may be initially surrounded by a mould before the matrix-forming compound is applied to the outer surface thereof, the compound being introduced, for example by injection, into cavities between the outer surface of the main bit body part and the inner surface of the mould.

Preferably the matrix-forming compound is dried before infiltration. The matrix-forming material may comprise powdered tungsten carbide of any of the forms normally used in the production of matrix bodied bits, and the binder may comprise a hydrocarbon, such as polyethylene glycol.

The elements inserted into the sockets before the application of matrix-forming compound to the main bit body part may comprise removable formers, and the method may include the further step, after infiltration of the matrix-forming compound, of removing the formers and inserting and securing cutting structures into the sockets.

Alternatively, the elements inserted into the sockets before application of the matrix-forming compound may themselves comprise cutting structures. It will be appreciated that in this case the cutting structures must be of such a nature as to withstand the infiltration temperature (of the order of 1050°-1170° C.). This may be achieved by using cutting structures which are thermally stable at such temperatures or by using a matrix-forming compound and infiltrant with which the resulting matrix may be formed at lower temperatures than those mentioned.

The invention includes within its scope a rotary drill bit including a main bit body part formed of machinable metal, such as steel, and having a shank for connection to a drill string, and an inner channel for supplying drilling fluid to the face of the bit, a plurality of sockets formed in the outer surface of the main bit body part, a plurality of cutting structures mounted in said sockets respectively, each cutting structure comprising a carrier which is received and secured within the socket and has a portion projecting therefrom and a preform cutting element mounted on the projecting portion of the carrier, and bodies of solid infiltrated matrix material applied to the outer surfaces of the main bit body part, at least in areas surrounding said cutting structures.

DETAILED DESCRIPTION OF THE PREFERRED EMBODIMENT

Figure 1:
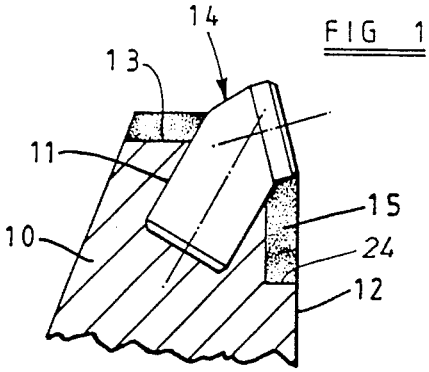
FIG. 1 is a diagrammatic section through part of a bit body in accordance with the invention.

Referring to FIG. 1, there is shown diagrammatically in section a portion of a blade 10 on the body of a rotary drill bit. The drill bit will normally have a number of such blades extending generally radially from the central axis of rotation of the bit. However, the actual design of the bit body does not form a part of the present invention and it will be apparent to those skilled in the art that the invention is applicable to many different types of drill bit. The detailed construction and design of the drill bit as a whole will not therefore be described in detail.

The main bit body part, including each blade 10, is machined from steel and also machined into the bit body, spaced apart along each blade, are a number of cylindrical sockets one of which is indicated diagrammatically at 11. In this case the socket 11 has been formed at the junction between a leading face 12 and an outer face 13 of the blade but any other suitable arrangement is possible. As previously mentioned, the sockets 11 may be machined by tools under computer control and may thus be dimensioned, located and orientated with great accuracy with respect to the main bit body part.

When all of the sockets 11 in the bit body part have been machined, there is inserted in each socket a former (not shown). This may be formed from metal, ceramic or any other suitable material.

There is then applied to the surface of the blade 10, surrounding the sockets 11, a layer of a matrix-forming compound in the form of a paste. The compound, which is sometimes known as "wet mix", comprises a matrix-forming powdered material, such as powdered tungsten carbide, mixed with a suitable binder to form a paste. The binder may for example be a hydrocarbon, such as polyethylene glycol. The compound is applied in a thick layer to the steel blade 10. A separate body of compound may be applied to the area around each former 14 or a continuous layer of compound may be applied along the length of the blade so as to surround each of a plurality of formers 14 in sockets 11 spaced apart along the length of the blade.

The leading face 12 of the blade may be formed with a recess 24, as shown, to receive the compound.

After application of the matrix-forming compound to the blade, the blade and compound are surrounded with conventional particulate mould-forming material. Any suitable particulate mould-forming material may be employed.

The matrix-forming compound 15 is preferably dried before the mould-forming compound is packed around it. The mould-forming material may be packed around the whole main bit body part or bodies of the material may be packed only around those portions of the main steel bit body part to which matrix-forming compound has been applied.

Channels are formed in the surrounding mould for the passage of the infiltrating metal alloy into the matrix-forming compound. The infiltration is carried out in a furnace in conventional manner.

After the matrix compound 15 has been infiltrated with the metal alloy and allowed to cool, the mould-forming material is removed from around the bit body and the formers are also removed. The cutting structures 14 of any appropriate form are then inserted and secured in the sockets 11 in any conventional suitable manner, for example by brazing, shrink fitting or interference fitting.

Figure 2:
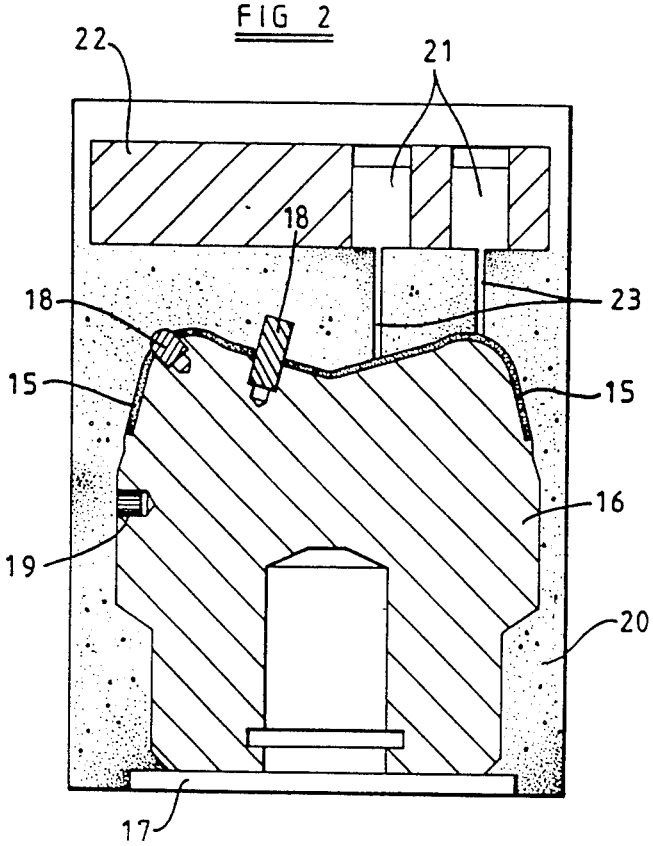
FIG. 2 is a diagrammatic section through a mould assembly showing a method of manufacturing a bit body.

FIG. 2 shows diagrammatically an arrangement whereby the matrix-forming compound may be infiltrated. Referring to the drawing, the steel bit body 16 to which the matrix-forming compound has been applied, as indicated at 15, is stood on a base 17 of monel metal, which is non-reactive with steel. Some of the formers which are located in the sockets in the steel body are indicated, by way of example, at 18. The bit body may also carry inserts of conventional form in the gauge region.

The matrix-forming compound may be applied to a thickness of 2–8 mm.

Around the bit body is packed mould-forming particulate material, as indicated at 20. Above the body of mould-forming material are mounted reservoirs 21 for infiltrant alloy in a steel enclosure 22. Channels 23 extend downwardly from the reservoirs 21 to the layers 15 of matrix-forming compound.

The whole assembly as shown in FIG. 2 is heated in a furnace to the infiltration temperature (around 1100° C.) at which temperature the infiltration alloy in the reservoirs 21 fuses and flows down through the channels 23 to infiltrate the layer 15 of matrix-forming compound.

In the case where the matrix-forming compound is received in recesses in the bit body, it may also be possible to infiltrate the compound and form the matrix without the use of such an external mould. For example, the bit body may be introduced into the matrix-forming furnace with a body of the infiltrant alloy overlying each recess filled with matrix-forming compound so that the alloy fuses and infiltrates downwardly into the recesses in the furnace.

In the arrangements described formers 18 are used to fill the sockets while the matrix is being formed. However, if the cutting structures to be used in the drill bit are such that they can withstand the infiltration temperature, the cutting structures themselves may be inserted in the sockets prior to application of the matrix-forming compound. This may be achieved by using thermally stable cutting elements, that is to say elements which are thermally stable at conventional infiltration temperatures, or by using low temperature infiltration processes.

I claim:

1. A method of manufacturing a rotary drill bit which includes the steps of forming a main bit body part from a machinable metal, machining in the outer surface of the main bit body part a plurality of sockets, inserting in each of said sockets an element which substantially fills at least the mouth of the socket and projects beyond the outer surface of the main bit body part, applying to the surface of the main body part, at least in an area surrounding each said socket, a compound comprising powdered matrix-forming material mixed with a binder to form a paste, enclosing the matrix-forming compound by packing particulate mould-forming material around at least the areas of the main bit body part to which said compound is applied, and infiltrating said matrix-forming compound with a metal alloy in a furnace to form a hard matrix.

2. A method according to claim 1, wherein the main bit body part is machined from steel.

3. A method according to claim 1, wherein the matrix-forming material comprises powdered tungsten carbide.

4. A method according to claim 1, wherein the binder comprises a hydrocarbon.

5. A method according to claim 4, wherein the binder comprises polyethylene glycol.

6. A method according to claim 1, wherein the elements inserted into the sockets before the application of matrix-forming compound to the main bit body part comprise removable formers, the method including the further step, after infiltration of the matrix-forming compound, of removing the formers and inserting and securing cutting structures into the sockets.

7. A method according to claim 1, wherein the elements inserted into the sockets before application of the matrix-forming compound comprise cutting structures, the cutting structures being of such a nature as to withstand the infiltration temperature.

8. A method of manufacturing a rotary drill bit which includes the steps of forming a main bit body part from a machinable metal, machining in the outer surface of the main bit body part a plurality of sockets, inserting in each of said sockets an element which substantially fills at least the mouth of the socket and projects beyond the outer surface of the main bit body part, surrounding the main bit body part by a mould to provide cavities between the outer surface of the main bit body part and the inner surface of the mould, at least in an area surrounding each said socket, introducing into said cavities a compound comprising powdered matrix-forming material mixed with a binder to form a paste, and infiltrating said matrix-forming compound with a metal alloy in a furnace to form a hard matrix.

9. A method according to claim 8, wherein the compound is introduced into said cavities by injection.

10. A method according to claim 8, wherein the main bit body part is machined from steel.

11. A method according to claim 8, wherein the compound is dried before infiltration of the matrix-forming compound.

12. A method according to claim 8, wherein the matrix-forming material comprises powdered tungsten carbide.

13. A method according to claim 8, wherein the binder comprises a hydrocarbon.

14. A method according to claim 13, wherein the binder comprises polyethylene glycol.

15. A method according to claim 8, wherein the elements inserted into the sockets before the application of matrix-forming compound to the main bit body part comprise removable formers, the method including the further step, after infiltration of the matrix-forming compound, of removing the formers and inserting and securing cutting structures into the sockets.

16. A method according to claim 8, wherein the elements inserted into the sockets before application of the matrix-forming compound comprise cutting structures, the cutting structures being of such a nature as to withstand the infiltration temperature.

17. A method of manufacturing a rotary drill bit which includes the steps of forming a main bit body part from a machinable metal, machining in the outer surface of the main bit body part a plurality of sockets, inserting in each of said sockets an element which substantially fills at least the mouth of the socket and projects beyond the outer surface of the main bit body part, applying to the surface of the main bit body part, at least in an area surrounding each said socket, a compound comprising powdered matrix-forming material mixed with a binder to form a paste, drying said compound, and then infiltrating said matrix-forming compound with a metal alloy in a furnace to form a hard matrix.

18. A method according to claim 17, wherein the main bit body part is machined from steel.

19. A method according to claim 17, wherein the matrix-forming material comprises powdered tungsten carbide.

20. A method according to claim 17, wherein the binder comprises a hydrocarbon.

21. A method according to claim 20, wherein the binder comprises polyethylene glycol.

22. A method according to claim 17, wherein the element inserted into the sockets before the application of matrix-forming compound to the main bit body part comprise removable formers, the method including the further step, after infiltration of the matrix-forming compound, of removing the formers and inserting and securing cutting structures into the sockets.

23. A method according to claim 17, wherein the elements inserted into the sockets before application of the matrix-forming compound comprise cutting structures, the cutting structures being of such a nature as to withstand the infiltration temperature.

* * * * *